US006494506B1

(12) United States Patent
Gleason et al.

(10) Patent No.: US 6,494,506 B1
(45) Date of Patent: Dec. 17, 2002

(54) LATCH AND ACTUATOR ASSEMBLY WITH NO-LOCK-OUT FEATURE

(75) Inventors: Stephen J. Gleason, Charles City, IA (US); Christopher M. Lane, Nashua, IA (US); David Alcantara, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 09/822,747

(22) Filed: Mar. 30, 2001

(51) Int. Cl.[7] ..... E05C 3/06
(52) U.S. Cl. ..... 292/216; 272/DIG. 23
(58) Field of Search ..... 292/169.14, 216, 292/336.3, DIG. 23; 70/237, 263, 264

(56) References Cited

U.S. PATENT DOCUMENTS

| | | | | | |
|---|---|---|---|---|---|
| 4,049,305 | A | | 9/1977 | Zetterlund et al. | 292/336.3 |
| 4,131,002 | A | | 12/1978 | Gianelo | 70/84 |
| 4,266,077 | A | | 5/1981 | Bohleen et al. | 292/336.3 |
| 4,420,954 | A | | 12/1983 | Hieronymi et al. | 70/150 |
| 4,438,964 | A | | 3/1984 | Peters | 292/216 |
| 4,494,783 | A | | 1/1985 | Poe | 292/155 |
| 4,588,219 | A | | 5/1986 | Kobayashi et al. | 292/336.3 |
| 4,703,963 | A | | 11/1987 | Ball | 292/336.3 |
| 4,743,052 | A | | 5/1988 | Stammreich et al. | 292/113 |
| 4,796,929 | A | * | 1/1989 | Gergoe | 292/28 |
| D303,618 | S | | 9/1989 | Russell et al. | D8/306 |
| 4,882,919 | A | | 11/1989 | Craig | 70/208 |
| 4,889,373 | A | | 12/1989 | Ward et al. | 292/336.3 |
| 4,913,477 | A | | 4/1990 | Watanuki et al. | 292/216 |
| 4,921,286 | A | * | 5/1990 | Nakamura | 292/216 |
| 4,929,007 | A | * | 5/1990 | Bartczak et al. | 292/216 |
| 5,100,185 | A | * | 3/1992 | Menke et al. | 292/216 |
| 5,174,619 | A | | 12/1992 | Bender et al. | 292/336.3 |
| 5,248,175 | A | | 9/1993 | Burns | 292/347 |
| 5,265,450 | A | | 11/1993 | Doyle | 70/118 |
| 5,277,461 | A | * | 1/1994 | Dzurko et al. | 292/216 |
| 5,295,374 | A | | 3/1994 | Bender et al. | 70/208 |
| 5,355,554 | A | | 10/1994 | Magoon | 16/124 |
| 5,570,915 | A | | 11/1996 | Asadurian | 292/242 |
| 5,611,224 | A | | 3/1997 | Weinerman et al. | 70/208 |
| 5,636,880 | A | | 6/1997 | Miller et al. | 292/144 |
| 5,689,980 | A | | 11/1997 | Weinerman et al. | 70/208 |
| 5,715,713 | A | * | 2/1998 | Aubry et al. | 292/201 |
| 5,746,458 | A | | 5/1998 | Fisher | 292/252 |
| 5,820,174 | A | | 10/1998 | Parikh et al. | 292/126 |
| 5,875,948 | A | | 3/1999 | Sadler | 224/404 |
| 5,941,104 | A | | 8/1999 | Sadler | 70/208 |
| 5,983,682 | A | | 11/1999 | Parikh | 70/208 |

* cited by examiner

*Primary Examiner*—Robert J. Sandy
*Assistant Examiner*—Dinesh N Melwani
(74) *Attorney, Agent, or Firm*—McKee, Voorhees & Sease, P.L.C.

(57) ABSTRACT

A latch and logic assembly is provided for a vehicle door which precludes the door from being accidentally locked. The latch includes a catch and a rotor movable between open and closed positions. The logic is mounted on the latch and is connected to the inside and outside handles of the door, and to the sill button on the door. The logic senses the position of the latch rotor and precludes movement of the sill button to the locked position when the rotor is in the open position, thus providing a no-lock-out function.

12 Claims, 10 Drawing Sheets

LATCH AND ACTUATOR ASSEMBLY WITH NO-LOCK-OUT FEATURE

BACKGROUND OF THE INVENTION

In vehicle doors, latches are provided for retaining the door in a closed position, with an associated logic or actuator assembly to control opening and closing of the door, as well as locking and unlocking of the latch mechanism. The door structure often includes an inside sill button which is movable between locked and unlocked positions. A common problem with vehicle doors is the accidental actuation or depressing of the sill button when the door is opened, which causes the door to be locked when the door is closed. Such automatic locking of the door upon accidental actuation of the sill button locks the person out of the vehicle if the keys are left in the vehicle or are not otherwise available.

Therefore, a primary objective of the present invention is the provision of an improved latch and logic assembly for a vehicle door having a no-lock-out feature.

Another objective of the present invention is the provision of an improved latch and logic assembly for vehicle doors having components which are economically manufactured and durable in use.

These and other objectives will become apparent from the following description of the invention.

SUMMARY OF THE INVENTION

The latch and logic assembly of the present invention includes a latch and an associated logic or actuator for mounting on a vehicle door. The latch has a catch and a rotor movable between a closed position to retain a striker bolt on the door and an open position to release the striker bolt. The logic is operatively connected to the inside and outside door handles, as well as to the sill button of the door. The logic is mounted on the latch and receives input from the inside and outside door handles and the sill button so as to control movement of the rotor between the open and closed positions.

More particularly, the logic includes an inside release arm connected to the inside door handle such that the logic moves the rotor from the closed position to the open position in response to input from the inside door handle. The logic also includes an outside release arm connected to the outside door handle, such that the logic moves the rotor from the closed position to the open position in response to input from the outside door handle. The logic further includes a lock arm connected to the sill button such that the logic will lock the rotor against movement from the closed position to the open position in response to input from the outside door handle when the sill button is locked. Also, when the rotor is in the open position, the lock arm will prevent the sill button from being moved to the locked position, thereby preventing accidental locking of the door.

DETAILED DESCRIPTION OF THE DRAWINGS

Figure 1:
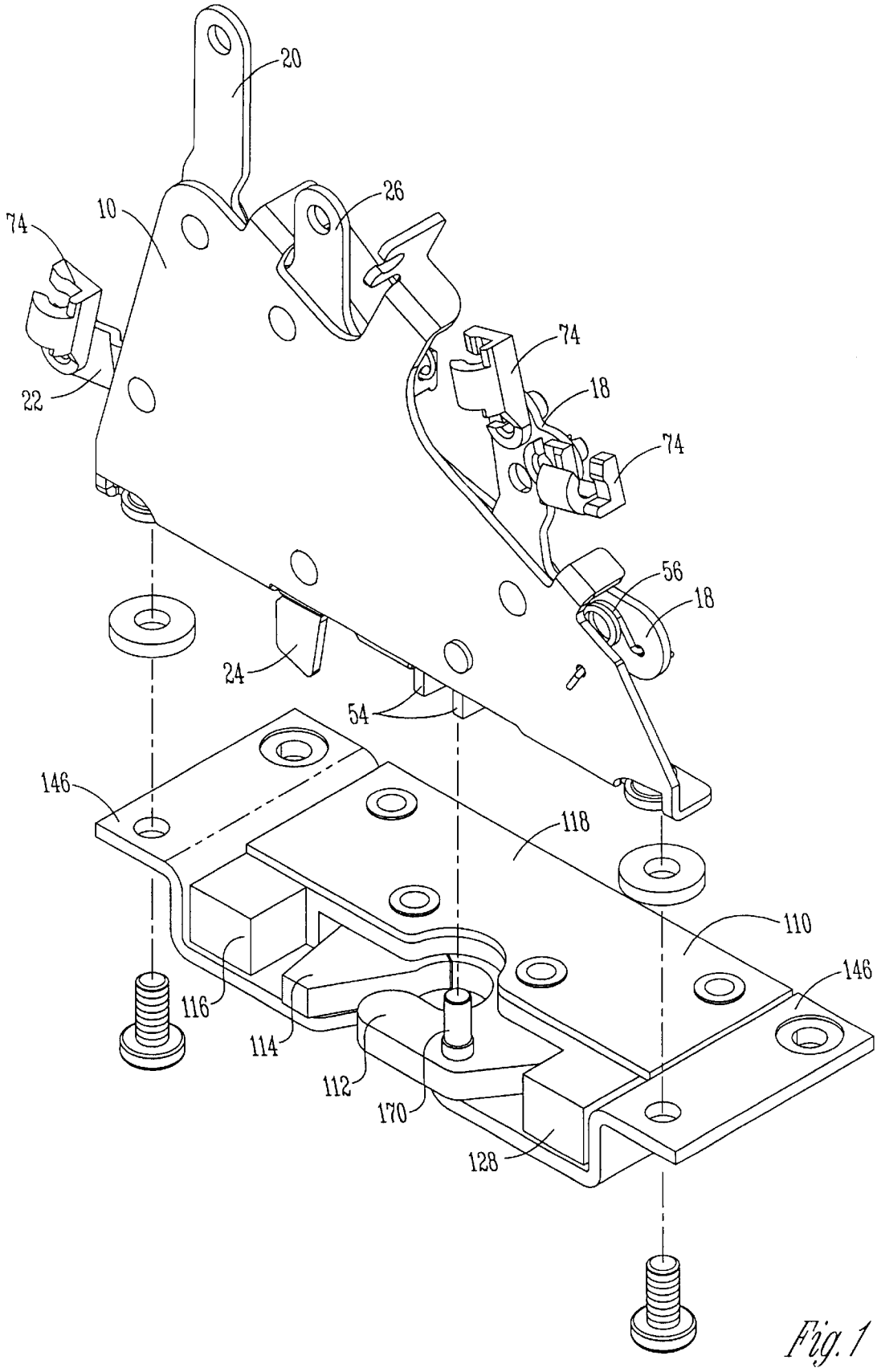
FIG. 1 is an exploded perspective view of the latch and logic assembly of the present invention.
Figure 2:
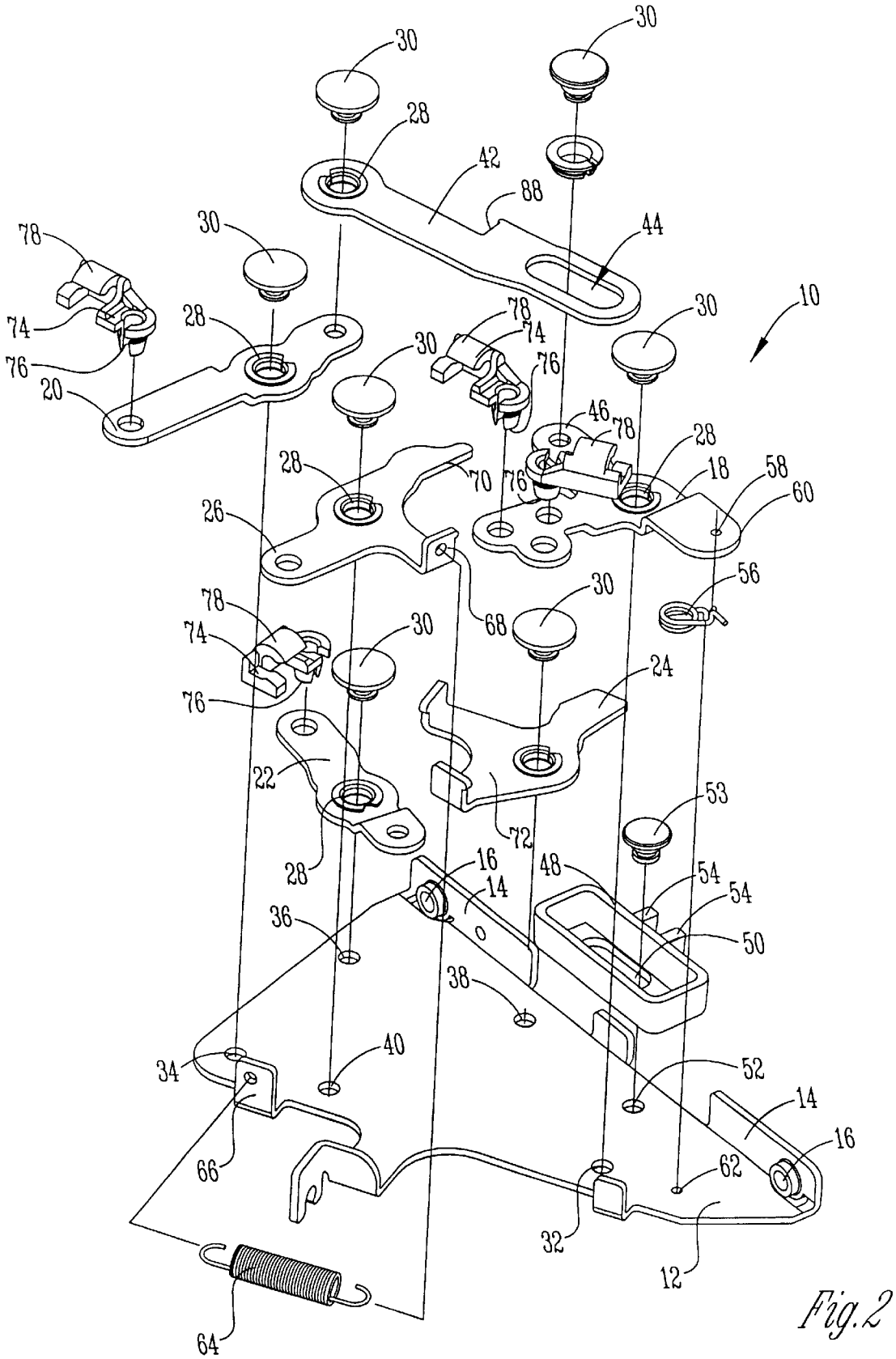
FIG. 2 is an exploded view of the logic components of the present invention.

The latch and logic assembly of the present invention generally includes a logic or actuator assembly 10 and a latch assembly 110 adapted for use in a vehicle door 210. The logic assembly 10 is universal in that it can be used on both the left-hand and right-hand door structures of the vehicle.

The logic assembly 10 includes a bracket 12 having a mounting flange 14 extending perpendicularly to the bracket 12. The mounting flange 14 includes a pair of threaded holes 16 for mounting the logic assembly 10 to the door structure 210, with the latch assembly 110 sandwiched therebetween.

The logic assembly 10 includes a plurality of lever arms mounted on the bracket 12. More particularly, the levers include a lock arm 18, an outside release arm 20, and inside release arm 22, an actuator arm 24, and a spring lever arm, 26. Each of these arms 18, 20, 22, 24 and 26 include a central aperture with a bushing 28 for pivotally mounting the respective arm to the mounting bracket 12 via a rivet 30 extending through the central opening in the respective arm and through a corresponding hole 32, 34, 36, 38, and 40 in the bracket 12.

A link arm 42 has an end with a central opening and a bushing 28 therein for pivotal connection to one end of the outside release arm 20, using a rivet 30. The opposite end of the link arm 42 includes an elongated slot 44 which slidably receives a bushing 28 for connection to a leg 46 of the lock arm 18 using a rivet 30.

A slide block 48 includes an elongated slot 50 and is slidably mounted to the bracket 12 using a rivet 30 extending through a hole 52 in the bracket 12. The slide block 50 includes a pair of legs 54 adapted to receive a pin 170 extending from the latch assembly 110 so as to open and close the latch rotor 112, as discussed below.

An over center spring 56 has a first end extending through a hole 58 in a leg 60 of the lock arm 18. The opposite end of the over center spring 56 is received in a hole 62 in the bracket 12. The over center spring 56 resides between the lock arm 18 and the bracket 12, and provides an opposition torque for the lock arm 18.

An extension spring 64 has one end received in a hole in a flange 66 extending perpendicularly from the bracket 12, as best seen in FIG. 1. The opposite end of the extension spring 64 is received in a hole on a flange 68 extending perpendicularly from the spring arm 26. The extension spring 64 normally biases a leg 70 of the spring arm 26 into engagement with a leg 72 of the actuator arm 24.

A plurality of clips 74 are provided for mounting in the lock arm 18, the outside release arm 20, and the inside release arm 22. More particularly, each clip 74 includes a male stub 76 adapted to snap fit into a corresponding hole in the arms 18, 20 and 22. Each clip 74 also includes a resilient retention member 78 adapted to receive a rod or cable from the door structure 210 to pivot or move the interconnected components and thereby control opening of the latch 110, as discussed below.

The logic assembly 10 has a narrow profile so as to accommodate internal door mounting. The assembly 10 is also designed to operate under adverse reliability, cyclic, environmental, high door weight, and high door sill load conditions, which are typical for on road and vocational vehicles.

Preferably, the arms 18, 20, 22, 24, 26 and 42 are stamped from CRS 14 AWG steel material, and plated with an option zinc, yellow finish or Nitrotec surface plating to provide protection against galling and wear, and resistance to corrosion. The mounting bracket is preferably manufactured from CRS 11 AWG steel, with a similar plating finish as the arms. The rivets 30 are preferably made from CRS rod material and plated with zinc, yellow finish. The bushings 28 are Teflon impregnated for a zero-zero or line fit with the rivets 30. The rivets thus provide excellent reduction of wear and gall, and have a very low coefficient affliction. The over center spring 56 and extension spring 64 are preferably manufactured from galvanized music wire material. Preferably, the over center spring 56 produces 10–18 in-lbs. of torque. The slidable lock is preferably manufactured from engineered plastic Nylon SIGs.

The latch assembly 110 includes a rotor 112 and a catch 114 pivotally mounted in a housing defined by a pair of housing plates 116, 118.

More particularly, the rotor 112 is mounted on an axle bearing 120 and the catch 114 is mounted on an axle bearing 122. A rotor spring 124 is mounted on one end of the axle 120, and a catch spring 126 is mounted on one end of the catch axle 122.

Preferably, the rotor 112 and catch 114 are impregnated with a lubricant, such as Gulf Lube, which is a thixotropic lubricant combined with selected thickeners, oxidation and corrosion inhibitors, and other additives. The Gulf Lube product is water-resistant and has low torque and low shear characteristics. The rotor 112 and catch 114 are also coated with the lubricant, such as grease. A grease housing or block 128 is provided between the housing plates 116, 118 to retain the grease within the housing, and to inhibit the entry of contaminants, such as moisture, dirt, and other particles, from the rotor 112 and catch 114.

The housing plates 116, 118 are secured together by the axles 120, 122 and similar bearings 130, 131. The axles 120, 122 and bearings 130, 131 each include an enlarged flange 132 at the opposite ends, and a reduced diameter portion 134 adjacent the flanges 132. The housing plates 116, 118 include a plurality of apertures 136, 138, respectively. The grease block 128 also has a plurality of holes 140. The axles 120, 122 and bearings 130, 131 extend through the aligned holes 136, 138 and 140 in the housing plates 116, 118 and the grease block 128. The diameter of the reduced diameter portion 134 is slightly smaller than the diameter of the holes 136, 138 in the housing plates 116, 118. In assembling the housing plates 116, 118, the axles 120, 122 are mechanically staked or wedged to secure the plates 116, 118 together.

The housing plate 116 includes a main body 142, a pair of up-turned legs 144, and a pair of out-turned arms 146. The arms 146 include holes 148 adapted to receive a bolt or screw 150 to externally mount the latch assembly 110 to a door frame 152, as shown in FIG. 10.

Figure 10:
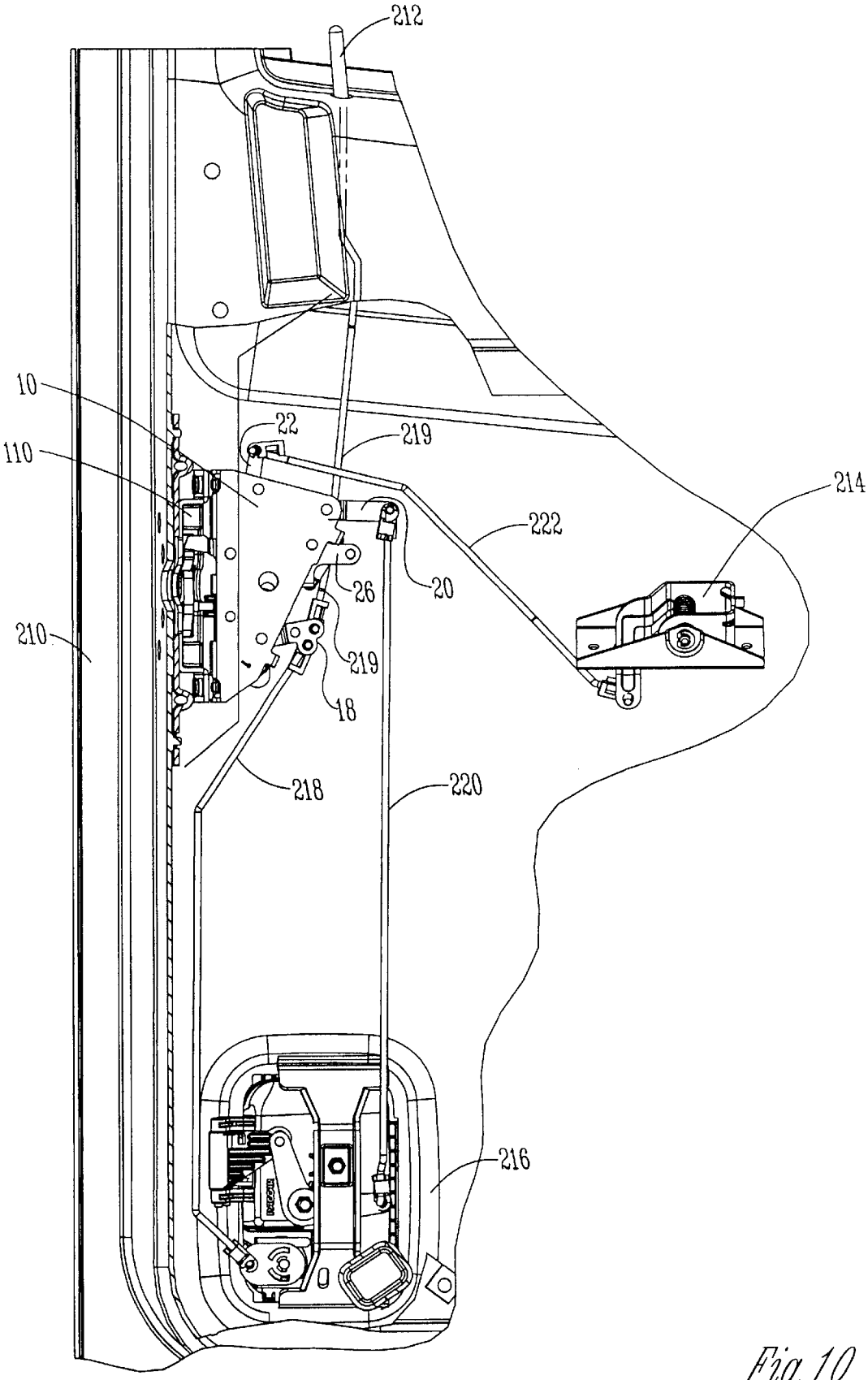
FIG. 10 is a side sectional view showing the latch and logic assembly mounted in a vehicle door.

At least some of the axles 120, 122 and bearings 130, 131 are internally threaded so as to be adapted to receive a bolt or screw 154 so that the latch assembly can be internally mounted to a door frame 156, as shown in FIG. 10.

Figure 3:
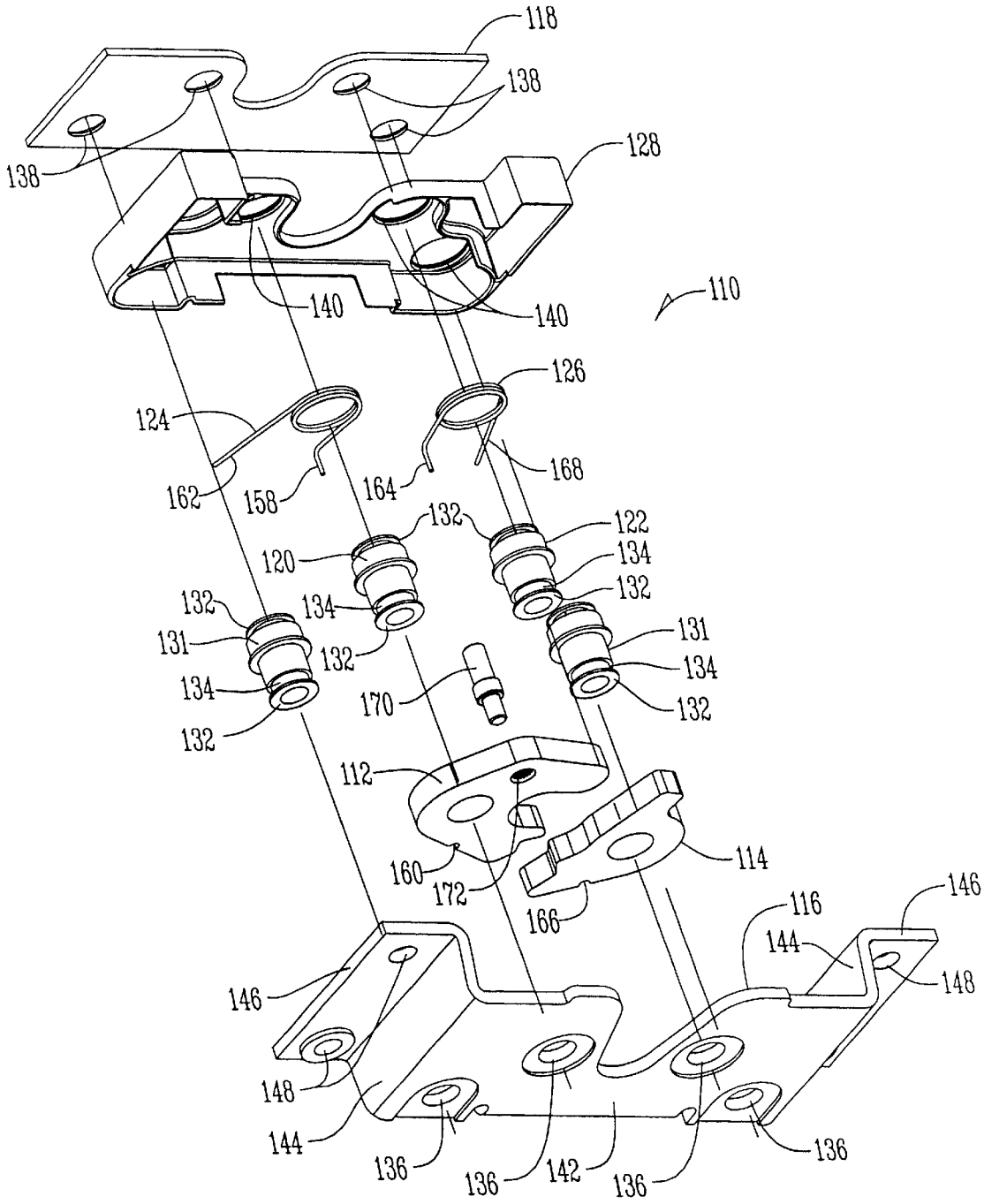
FIG. 3 is an exploded view of the latch components of the present invention.
Figure 4:
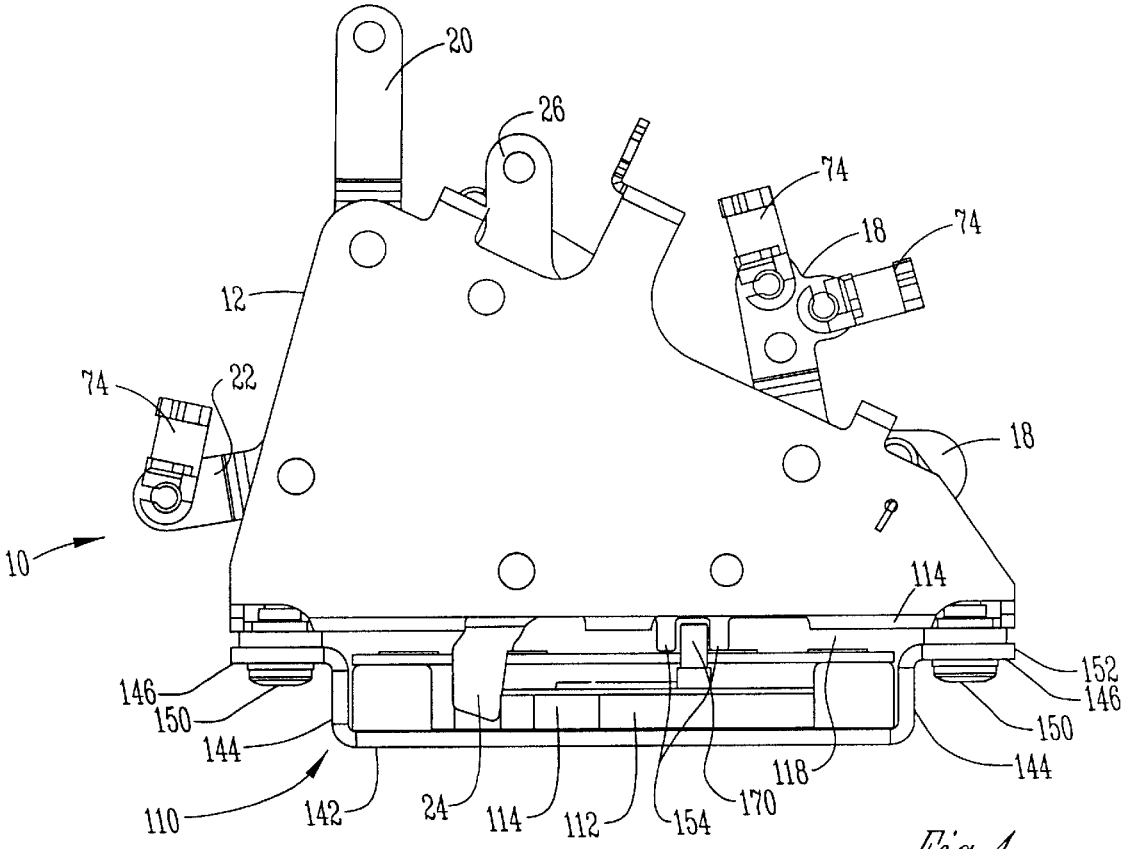
FIG. 4 is a rear elevation view of the latch and logic assembly of the present invention.
Figure 5:
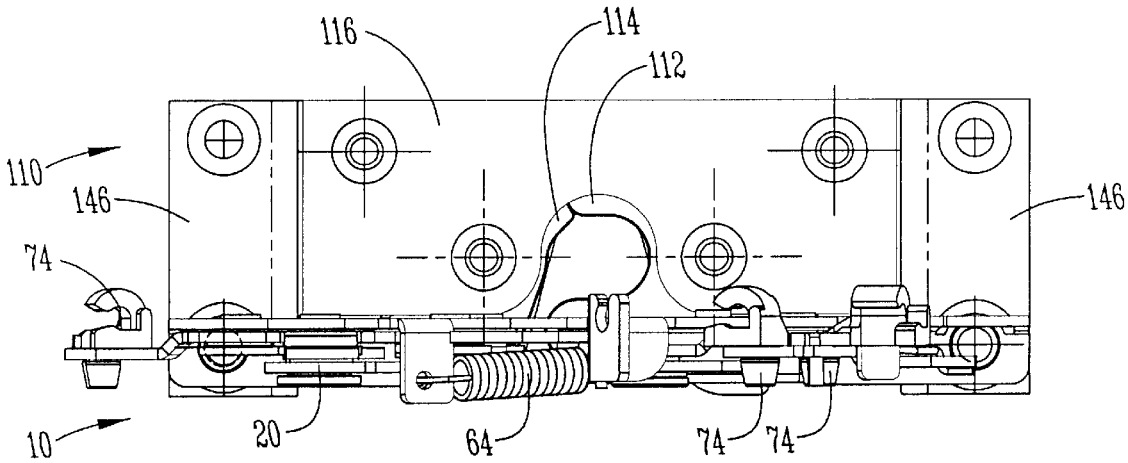
FIG. 5 is a top plan view of the latch and logic assembly of the present invention.

The rotor spring 124 lies around the rotor axle 120, and includes a leg 158 captured in a groove 160 in the rotor 112. The rotor spring 124 includes an opposite leg 162 which engages the upper left-hand bearing 130, as seen in FIG. 3. The rotor spring 124 functions to eject the rotor 112 to the open position when released from the catch 114. The catch spring 126 includes a leg 164 received in a groove 166 in the catch 114, and an opposite leg 168 engaging the upper right hand bearing 131, as seen in FIG. 3. The catch spring 126 functions to return the catch 114 to the locked position.

The overall thickness of the latch assembly 110 allows the assembly to have a great amount of door clearance when externally mounted. The latch assembly 110 allows for door racking in the positive Y direction, thereby assisting a reduction of door appeture and hinge stress.

Preferably, the housing plates 116, 118 are made of steel, with a zinc yellow chromate finish to provide corrosion resistance. The rotor 112 and catch 114 are preferably manufactured from high density powdered metal material, with a zinc yellow chromate coating finish, so as to provide maximum strength versus weight, reduced coefficient of friction, increased resistance to wear, and increased resistance to corrosion. The axles 122, 124 are preferably manufactured from a high strength, machinable steel, with a zinc yellow chromate finish. The grease block 128 is preferably manufactured from engineered plastic, since it is a non-load-bearing component. The springs 124, 126 are preferably manufactured from stainless steel spring wire to provide resistance to corrosion.

The latch assembly 110 includes a rotor pin 170 which is pressed into a hole 172, and serves as an interface component with the slide block legs 54 of the logic assembly 10. The pin 170 functions with slide block 50 in the logic assembly 10 to preclude locking of the door 210 when the rotor 112 and catch 114 are in the open position.

The latch 110 meets all Federal Motor Vehicle Safety Standards for transverse and longitudinal loads.

The logic assembly 10 thus provides a non-handed input/output mechanism which accepts user input from internal and external door handles, latch actuation devices, and release mechanisms. The user inputs are transferred to an output motion by the logic assembly 10 and then to the latch assembly 110 for opening the vehicle doors 210. The logic assembly 10 can be used with single or double rotor latch assemblies. The input functions include input from the inside door handle 214, input from the release and lock devices of the 216 outside door handle, input from the sill button 212, and input from the rotor pin 170 of the latch 110. The output is actuation of the latch assembly rotor 112, thus causing the latch 110 to open.

After the logic 10 and latch 110 are assembled together, the assembly is mounted in the door 210, for example, as seen in FIG. 10. The lock arm 18 of the logic 10 is connected to the outside door handle 216 by a rod 218, and is connected to the seal button 212 by a rod 219. The outside release arm 20 of the logic 10 is connected to the outside door handle 216 by a connecting rod 220. The inside release arm 22 is connected to the inside door handle 214 by a connecting rod 222.

Figure 6:
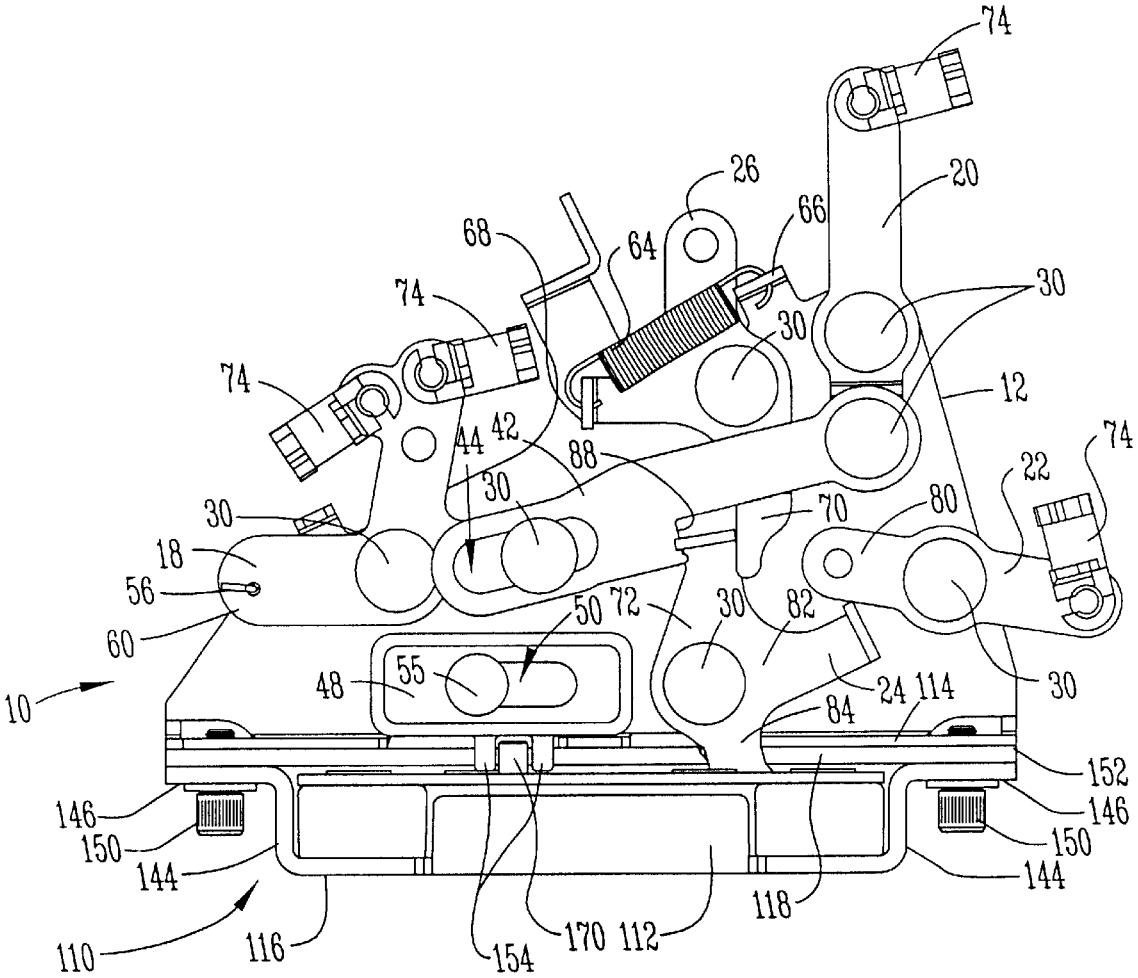
FIG. 6 is a front elevation view of the latch and logic assembly of the present invention with the lock arms pivoted to a first position wherein the vehicle door is closed and unlocked.
Figure 8:
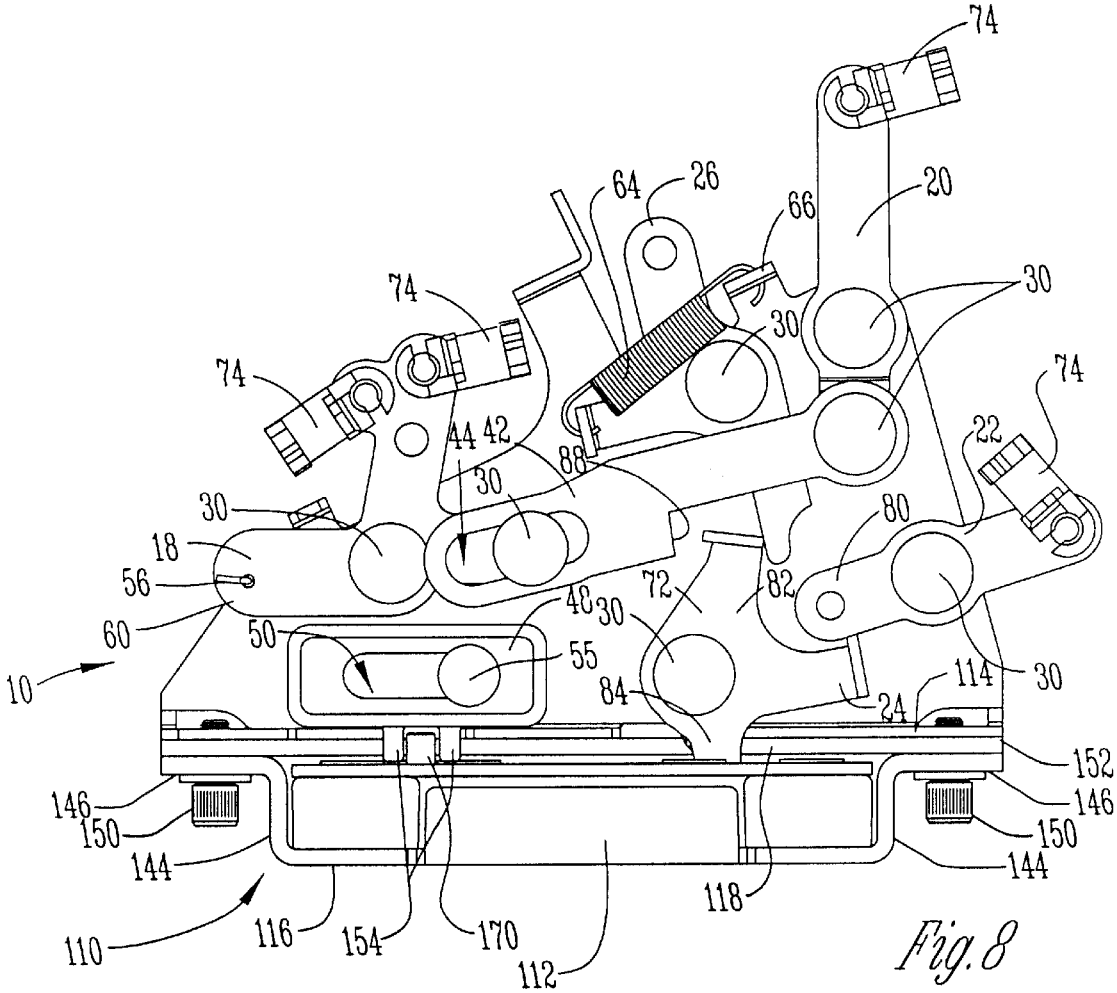
FIG. 8 is a view similar to FIG. 6 with the inside release arm, spring arm and slide block moved to a latch-opening position when the inside door handle is actuated.

In operation, when the latch rotor 112 is closed, the lever arms 18, 20, 22, 24, 26 and 42 and the slide block 48 are in the position shown in FIG. 6. When a person in the vehicle actuates the interior door handle 214, the inside release arm 22 is pivoted in a counterclockwise direction, as seen in FIG. 8, such that the inner end 80 of the arm 22 engages a leg 82 of the actuator arm 24, to thereby rotate the actuator arm in clockwise direction such that a lower leg 84 of the actuator 9 arm 24 pivots the latch catch 114 so as to release the latch rotor 112 to an open position, such that the vehicle door 210 can be opened.

Figure 7:
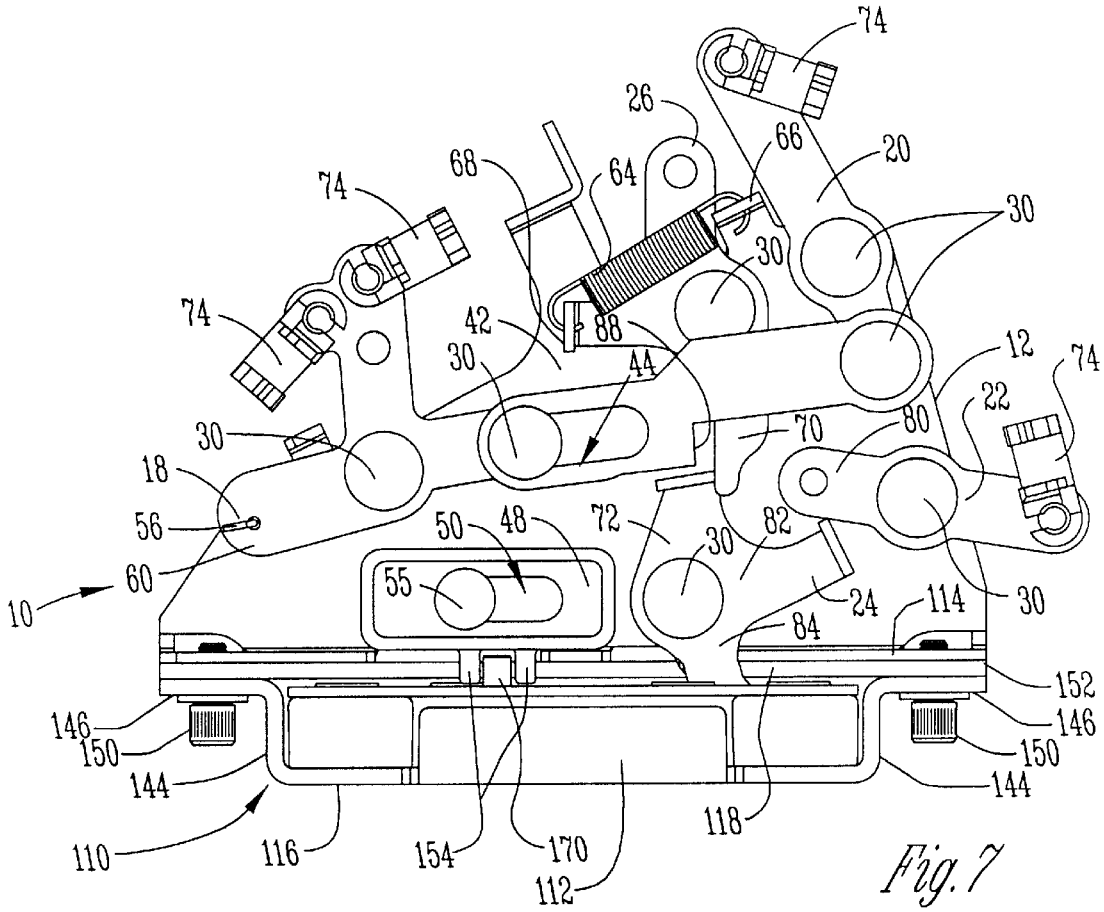
FIG. 7 is a view similar to FIG. 6 with the lock arm, outside release arm, and link arm pivoted to a second position when the sill button is moved to a locked position to lock the vehicle door.

When the outside vehicle door handle 216 is actuated, the outside release arm 20 is pivoted counterclockwise, as seen in FIG. 7, such that the end 86 of the arm 20 pulls the link arm 42 towards the right (as seen in FIG. 7), such that a shoulder 88 engages the leg 72 of the actuator arm 24, which in turn releases the latch catch 114 so that the latch rotor 112 moves to an open position, such that the vehicle door 210 can be opened. The extension spring 64 normally biases the spring arm 26 and actuator arm 24 to the initial position shown in FIG. 6.

When the vehicle door 210 is closed, the sill button lock knob 212 can be actuated to lock the door 210. Actuation of the sill lock knob 218 rotates the lock arm 18 in a counterclockwise direction, as shown in FIG. 8, which raises or pivots the link arm 42 such that the shoulder 88 is disengaged from the leg 72 of the actuator arm 24. Accordingly, the latch catch 114 cannot be tripped by the actuator arm 24 if someone lifts or actuates the outside vehicle door handle 216. Therefore, the door 210 cannot be opened from the outside if the latch 110 is locked. However, actuation of the inside door handle 214 still permits the inside release arm 22 to rotate and pivot the actuator arm 24 to release the latch catch 114, such that the vehicle door 210 can be opened from the inside.

Figure 9:
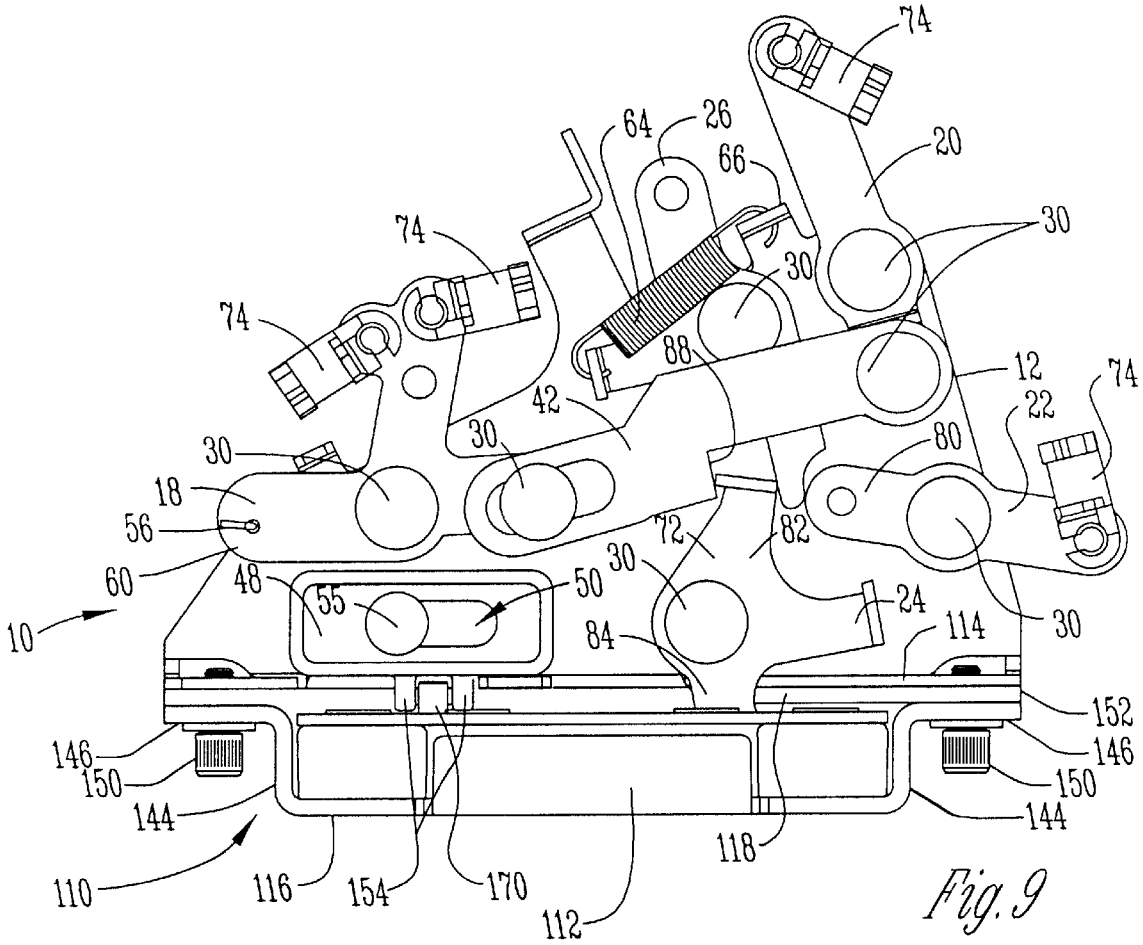
FIG. 9 is a view similar to FIG. 6 with the outside release arm, spring arm, link arm and actuator arm moved to a latch-opening position when the outside door handle is actuated.

The latch and logic assembly of the present invention provides a no-lock-out feature for the vehicle door 210 so as to prevent accidental locking of the door. More particularly, when the latch rotor 112 is moved to the unlocked position such that the door 210 can be opened, the pin 170 on the latch 110 moves the slide block 48 of the logic assembly 10 to the left, as seen in FIG. 9. This lateral movement of the slide block 48 prevents the lock arm 18 from pivoting, thereby preventing the sill button 212 from being pushed down to the locked position. Thus, when the door 210 is open, a person cannot lock the latch and logic assembly by accidentally hitting the sill button 212. Accordingly, the person cannot be accidentally locked out of the vehicle.

From the forgoing, it can be seen that the present invention accomplishes at least all the stated objectives.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A latch and actuator assembly for a vehicle door, having an outside handle and an inside sill button, the assembly comprising:

a latch having a catch and a rotor movable between a closed position to retain a striker bolt on the door and an open position to release the striker bolt;

an actuator operatively connected to the outside handle , the inside handle and the sill button of the door and being mounted on the latch;

the actuator moving the rotor from the closed position to the open position in response to input from the inside and outside door handles; the actuator locking the rotor against movement from the closed position to the open position in response to input from the sill button; and the actuator precluding actuation of the sill button when the rotor is in the open position, wherein the actuator includes a slide block operatively connected to the rotor to move the rotor between the open position and closed positions, and to preclude input from the sill button when the rotor is in the open position.

2. The latch and actuator assembly of claim 1 wherein the actuator includes a lock arm operatively connected to the sill button and being movable between locked and unlocked positions in response to input from the sill button.

3. The latch and actuator assembly of claim 2 wherein the slide block precludes the lock arm from moving to the locked position when the rotor is open.

4. The latch and actuator assembly of claim 2 wherein the lock arm prevents the rotor from moving to the open position in response to input from the outside door handle when the lock arm is in the locked positions.

5. The latch and actuator assembly of claim 1 wherein the actuator includes and inside release arm operatively connected to the inside door handle, an outside release arm operatively connected to the outside door handle, and a lock arm operatively connected to the sill button and to the outside door handle.

6. The latch and actuator assembly of claim 1 wherein the actuator further includes an actuator arm operatively engaged by the inside and outside release arms and operatively engaging the catch of the latch to move the rotor from the closed to the open position.

7. The method of preventing accidental lock-out on a vehicle door, the door having inside and outside handles, a sill button movable between locked and unlocked positions, a latch having a catch and a rotor movable between open and closed positions, and an actuator operatively connected to the inside and outside door handles, the sill button and the latch rotor, the method comprising: precluding the sill button from moving to the locked position when rotor is in the open position, wherein said actuator includes an actuator arm operatively connected to the sill button and a slide block operatively connected to the latch rotor, and wherein the sill button is precluded from moving to the lock position by the lock arm.

8. The method of claim 7 further comprising moving the lock arm between locked and unlocked positions in response to input from the sill button, and blocking the movement of the lock arm to the lock position with the slide block when the rotor position is in the open position.

9. The method of claim 8 wherein blocking the movement of the lock arm to the lock positions precludes the sill button from moving to the locked position.

10. A latch and actuator assembly for a vehicle door having inside and outside handles and a sill button movable between a locked and unlocked positions, the assembly comprising:

a latch having a catch and a rotor movable between open and closed positions;

an actuator mounted on the latch and being connected to the inside and outside door handles and to the sill button; and the actuator precluding movement of the sill button to the locked position when the rotor is in the open position, wherein the actuator includes a slide block connected to the rotor.

11. The latch and actuator assembly of claim 10 wherein the logic includes a actuator arm connected to the sill button and being movable between locked and unlocked position in response to input from the sill button.

12. The latch and actuator assembly of claim 11 wherein the slide block prevents the lock arm from moving to the locked position when the rotor is in the open position such that the sill button is precluded from moving to the locked position.

* * * * *